United States Patent [19]

Isgar et al.

[11] Patent Number: 4,576,310

[45] Date of Patent: Mar. 18, 1986

[54] CONTAINER FOR USE WITH PLASTIC BAGS

[76] Inventors: Charles B. Isgar, 1014 S. Ogden St., Denver, Colo. 80209; Shirley K. Isgar, 1104 Maxwell, Boulder, Colo. 80302

[21] Appl. No.: 630,495

[22] Filed: Jul. 13, 1984

[51] Int. Cl.[4] ..... B65D 90/04

[52] U.S. Cl. ..... 220/404; 220/1 T; 220/403

[58] Field of Search ..... 220/404, 403, 1 T

[56] References Cited

U.S. PATENT DOCUMENTS

| | | | |
|---|---|---|---|
| 1,938,452 | 12/1933 | Griesmeyer | 220/404 |
| 3,888,406 | 6/1975 | Nippes | 220/1 T |
| 4,062,170 | 12/1977 | Orem | 53/390 |
| 4,294,379 | 10/1981 | Bard | 220/404 |
| 4,332,361 | 6/1982 | McClellan | 248/95 |
| 4,418,835 | 12/1983 | Watts | 220/404 |

FOREIGN PATENT DOCUMENTS

| | | | |
|---|---|---|---|
| 1533744 | 11/1978 | United Kingdom | 220/404 |

*Primary Examiner*—John Kittle
*Assistant Examiner*—James J. Seidleck
*Attorney, Agent, or Firm*—Joseph J. Kelly

[57] ABSTRACT

A rigid, self-sustaining plastic container is provided with cooperating notches and hooks for supporting a plastic bag, having handles secured thereto and wherein an opening is formed between each handle and the plastic bag, in the container so that the bottom of the plastic bag is adjacent to the bottom of the container and the open end of the plastic bag is held open so that items may be placed therein.

10 Claims, 3 Drawing Figures

12
18
34
6

12
26
18
34
6

28
20
52
16
12
10
30
22
14
8
26
34
18
50
42
44
46
48
36
32
24
38
40
2
6
6
4

CONTAINER FOR USE WITH PLASTIC BAGS

FIELD OF THE INVENTION

This invention is directed to a container particularly for use with plastic bags, particularly the plastic bags used by commercial stores to hold customer goods, which plastic bags are provided with at least two handles so that the plastic bags, after being loaded, may be grasped by the handles and transported.

BACKGROUND OF THE INVENTION

In recent years, many commercial stores have switched from paper bags for holding customer purchased goods to plastic bags. These plastic bags are formed from a limp plastc film and are not self-supporting. Since it is highly desirable that the customer be able to reuse these bags, such as liners for household trash containers, efforts have been made to provide suitable apparatus for supporting these plastic bags in containers. In Watts (U.S. Pat. No. 4,418,835), there is disclosed a bracket that is secured to a household trash container using bolts passing through openings in the trash container and the bracket and secured to the container using nuts. One problem associated with Watts is that the bracket is fixed in position so that it is not readily adapted for use with plastic bags having a substantially different size. Once the brackets in Watts have been installed, if another plastic bag is obtained and is too small, the bottom of the platic bag will not be in contact with the bottom of the container, and if another plastic bag is obtained and is too large, the top of the plastic bag will not be held open. McClellan (U.S. Pat. No. 4,332,316) discloses a pair of brackets having tabs provided with openings so that the brackets may be attached to a wall or door. The brackets of McClellan have to be structurally strong since they actually support the bag and any item placed in the bag. Orem (U.S. Pat. No. 4,062,170) discloses apparatus for loading plastic bags wherein the handles of the plastic bag are placed over tabs while the bottom of the plastic bag is supported on a bottom wall. Orem is similar to Watts in that it is suited only for use with one size of plastic bag.

BRIEF DESCRIPTION OF THE INVENTION

This invention provides a container particularly for use in supporting plastic bags wherein each of the plastic bags has at least two handles with an opening formed between each handle and the body of the plastic bag and wherein the container is provided with means so as to be capable of supporting different sizes of plastic bags.

In the preferred embodiment of the invention, the container has a bottom with an upstanding peripheral wall secured thereto and wherein the peripheral wall terminates to form an edge defining an opening at the top of the container. The container has a shape generally similar to an inverted frustum of a rectangular pyramid so that the edge forming the opening is generally rectangular having two long sides, two short sides and four corners. A first pair of spaced apart notches extend downwardly from the edge of one of the short sides into the peripheral wall. Each notch of the first pair notches is located adjacent one of the corners at the ends of one short side. A second pair of spaced apart notches extend downwardly from the edge of the other of the short sides into the peripheral wall. Each notch of the second pair of notches is located adjacent one of the corners at the ends of the other short side. Each notch is dimensioned so that a portion of each handle may be inserted and retained therein.

A first plurality of hooks are secured to the outer surface of the peripheral wall below the one short edge side of the container. The first plurality of hooks are in vertical alignment, are spaced a distance from each other and are located between the first pair of notches and spaced at predetermined distances below the first pair of notches. A second plurality of hooks are secured to the outer surface of the peripheral wall below the other short side edge of the container. The second plurality of hooks are in vertical alignment, are spaced a distance from each other and are located between the second pair of notches and spaced at predetermined distances below the second pair of notches. The hooks cooperate with each pair of notches in supporting the handles of a plastic bag inserted into the container so that the bottom of the plastic bag is in contact with the bottom of the container and the open end of the plastic bag is held open so that items may be placed therein.

In another preferred embodiment, the first pair of notches are located so that each notch is located in one of the corners at the ends of one of the short sides. The second pair of notches are located so that each notch is located in one of the corners at the ends of the other of the short sides.

It is an object of this invention to provide a container for use with plastic bags having at least two handles, each of which defines an opening between the handle and the plastic bag, which container can be used with different sizes of plastic bags.

It is another object of this invention to provide a container for use with plastic bags having at least two handles, each of which defines an opening between the handle and the plastic bag, which container can support different sizes of plastic bags while permitting the bottom of the plastic bag to be in contact with the bottom of the container and holding the open end of the plastic bag open so that items may be inserted therein.

Other features and advantages of the invention will be apparent from the following more particular description of preferred embodiments as illustrated in the accompanying drawing in which like reference characters refer to the same parts throughout the various views. The drawing is not necessarily to scale, emphasis instead being placed upon illustrating the principles of the invention.

DETAILED DESCRIPTION OF THE INVENTION

Figures 1, 2, 3:
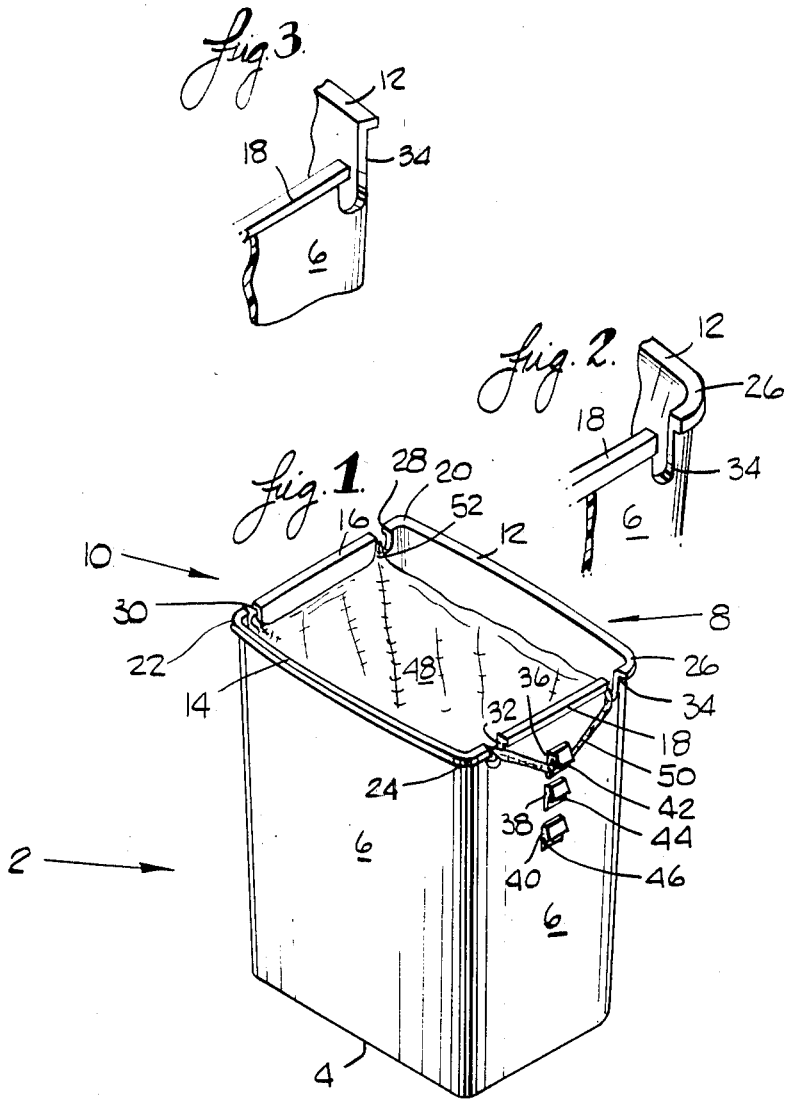
FIG. 1 is a pictorial view of a container of this invention with a plastic bag supported therein.
FIG. 2 is an enlarged view showing one of the notches of FIG. 1.
FIG. 3 is an enlarged view showing another embodiment illustrating a different location for the notches.

One of the preferred embodiments of the invention is illustrated in FIG. 1 and comprises a container 2 having a bottom 4 and an upstanding peripheral wall 6 secured thereto. The upstanding peripheral wall 6 terminates to form an edge 8 which defines an opening 10 at the top of the container 2. In the preferred embodiment of the invention, the container 2 has a shape generally similar to an inverted frustum of a rectangular pyramid so that the edge 8 is generally rectangular having two long sides 12 and 14, two short sides 16 and 18 and four corners 20, 22, 24 and 26. It is to be understood that the container 2 may be of other geometrical configurations but that the configuration described above is preferred.

A first pair of notches 28 and 30 are formed in the short side 16. As illustrated in FIG. 1, each of the notches 28 and 30 extend downwardly from the edge 8 of the short side 16 into the peripheral wall 6. The notch 28 is adjacent the corner 20 and the notch 30 is adjacent the corner 22. A second pair of notches 32 and 34 are formed in the short side 18. As illustrated in FIG. 1, each of the notches 32 and 34 extend downwardly from the edge 8 of the short side 18 into the peripheral wall 6. The notch 32 is adjacent the corner 24 and the notch 34 is adjacent the corner 26. The notches 28, 30, 32 and 34 are dimensioned so that a portion of a handle of a plastic bag may be inserted and retained in each of the notches for a purpose to be described below.

A plurality of hooks 36, 38 and 40 are secured to the outer surface 42 of the peripheral wall 6 below the short side 18 of the edge 8. In the preferred embodiment of the invention, the hooks 36, 38 and 40 are integral with the peripheral wall 6. However, it is understood that the hooks 36, 38 and 40 could be formed separately and secured to the outer surface 42 of the peripheral wall 6 by any suitable means, such as an adhesive. The hooks 36, 38 and 40 are dimensioned so as to provide downwardly facing recesses 42, 44, and 46 which are dimensioned so that a portion of a handle of a plastic bag may be inserted and retained therein. Similar hooks (not shown) are located on the outer surface of the peripheral wall 6 between and below the notches 28 and 30.

The plastic bag is partially illustrated in FIG. 1 and comprises a body 48 and handles 50 and 52. The plastic bag is conventional and is of the type illustrated in the Watts and Orem patents, described above. The plastic bag is formed from a thin plastic material and is limp with no self-sustaining characteristics.

In operation, the body 48 of a plastic bag is inserted into the container 2. The handle 50 is grasped and a portion thereof is inserted into the notch 34 and another portion thereof is inserted into the notch 32. The other handle 52 is grasped and a portion thereof is inserted into the notch 30 and another portion thereof is inserted into the notch 28. The portion of the handle 50 between the notches 32 and 34 and the portion of the handle 52 between the notches 28 and 30 are grasped and moved downwardly. The downward movement of the handles 50 and 52 is continued until substantially only the bottom of the plastic bag is in contact with the bottom of the container 2 and the sides defining the open end of the plastic bag are held in position adjacent the inner surface of the container 2 between the notches 32 and 34 and the notches 28 and 30. A portion of the handle 50 between the notches 32 and 34 is then positioned in one of the recesses 42, 44 and 46 to retain the plastic bag in the desired position. Thus, the hooks cooperate with each pair of notches in supporting the handles of a plastic bag which has been inserted into a container so that the bottom of the plastic bag is in contact with the bottom of the container and the open end of the plastic bag is held open so that items may be inserted therein.

Another preferred embodiment of the invention is illustrated in FIG. 3. In this embodiment, the notches 28, 30, 32 and 34 are located where the corners 20, 22, 24 and 26 are. This embodiment provides a greater distance between the notches 34 and 36 and the notches 28 and 30 so as to provide a wider opening for the plastic bag. Although not shown, it is within the concepts of this invention to locate the notches 28, 30, 32 and 34 in the long sides 12 and 14 adjacent the corners 20, 22, 24 and 26 so as to provide the plastic bag with its widest possible opening.

While the preferred embodiment of the invention uses the hooks to assist in securing a portion of each of the handles in the notches, other means, such as specially shaped surfaces forming each notch, could be used to secure a portion of each of the handles in each notch. One such configuration could be to form the notch in the shape of a V so that a portion of each handle could be wedged down into the V.

In the preferred embodiment of the invention, the container 2 is molded from a plastic material such as a polyvinyl chloride so as to be a rigid self-supporting container. However, it is understood that the container can be formed from other similar materials or even metal. Although only three hooks 36, 38 and 40 are illustrated, it is understood that there can be as many as desired. Also, Although the hooks 36, 38 and 40 are illustrated as one row of aligned hooks, it is understood that two or more rows of hooks may be utilized.

While the preferred embodiments of the invention have been illustrated and described herein, it may be otherwise embodied and practiced within the scope of the following claims.

What is claimed is:

1. In a container supporting a limp, nonself-supporting plastic bag wherein the plastic bag has at least two handles adjacent the open end thereof and wherein each handle forms an opening between the handle and the body of the plastic bag, the improvement comprising:

a hollow container having a bottom and an upstanding peripheral wall secured to said bottom and defining an opening at the top end of said peripheral wall;

a peripheral edge defined by the termination of said peripheral wall;

a first pair of spaced apart notches extending downwardly from said edge into said peripheral wall;

spaced apart portions of one of said handles inserted and retained in said first pair of notches;

a second pair of spaced apart notches located opposite to said first pair of notches and extending downwardly from said edge into said peripheral wall;

spaced apart portions of the second of said handles inserted and retained in said second pair of notches; and means for securing a portion of each of said handles located between said spaced apart portions to said peripheral wall so that the bottom of said plastic bag is adjacent to said bottom of said container and the open end of said plastic bag is held in an open position so that items may be placed therein.

2. A container as in claim 1 wherein said means for securing a portion of each of said handles in said notches comprises:

a first plurality of hooks;

means for securing said first plurality of hooks to the outer surface of said peripheral wall at a location between said first pair of notches and spaced a predetermined distance below said first pair of notches;

a second plurality of hooks;

means for securing said second plurality of hooks to the outer surface of said peripheral wall at a location between said second pair of notches and spaced at predetermined distances below said second pair of notches; and each of said hooks having dimensions permitting a portion of each of said handles to be inserted and retained therein.

3. A container as in claim 2 wherein:

each of said hooks is integral with said container.

4. A container as in claim 2 wherein:

said first plurality of hooks are in vertical alignment and spaced a distance from each other; and said second plurality of hooks are in vertical alignment and spaced a distance from each other.

5. A container as in claim 2 wherein:

said container has a shape generally similar to an inverted frustum of a rectangular pyramid so that said peripheral edge is rectangular having two long sides, two short sides and four corners;

said first pair of notches being located in one of said short sides with each notch being located adjacent one of said corners; and said second pair of notches being located in the other of said short sides with each notch being located adjacent one of said corners.

6. A container as in claim 5 wherein:

each of said hooks is integral with said container.

7. A container as in claim 5 wherein:

said first plurality of hooks are in vertical alignment and spaced a distance from each other; and said second plurality of hooks are in vertical alignment and spaced a distance from each other.

8. A container as in claim 2 wherein:

said container has a shape generally similar to an inverted frustum of a rectangular pyramid so that said peripheral edge is rectangular having two long sides, two short sides and four corners;

each notch of said first pair of notches is located in one of the corners at the ends of one of said short sides; and each notch of said second pair of notches is located in one of the corners at the ends of the other of said short sides.

9. A container as in claim 8 wherein:

each of said hooks is integral with said container.

10. A container as in claim 8 wherein:

said first plurality of hooks are in vertical alignment and spaced a distance from each other; and said second plurality of hooks are in vertical alignment and spaced a distance from each other.

* * * * *